US011511507B2

(12) United States Patent
Thierry

(10) Patent No.: US 11,511,507 B2
(45) Date of Patent: Nov. 29, 2022

(54) ARTICLE HANDLING DEVICE FOR ERECTING CARTONS

(71) Applicant: WestRock Packaging Systems, LLC, Atlanta, GA (US)

(72) Inventor: Willy G. Thierry, Ablenay (FR)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 0 days.

(21) Appl. No.: 16/757,185

(22) PCT Filed: Sep. 28, 2018

(86) PCT No.: PCT/US2018/053345
§ 371 (c)(1),
(2) Date: Apr. 17, 2020

(87) PCT Pub. No.: WO2019/079016
PCT Pub. Date: Apr. 25, 2019

(65) Prior Publication Data

US 2021/0197513 A1 Jul. 1, 2021

Related U.S. Application Data

(60) Provisional application No. 62/574,451, filed on Oct. 19, 2017.

(51) Int. Cl.

| | |
|---|---|
| ***B31B 50/80*** | (2017.01) |
| ***B31B 50/10*** | (2017.01) |
| *B31B 100/00* | (2017.01) |
| *B31B 120/30* | (2017.01) |
| *B31B 110/35* | (2017.01) |

(52) U.S. Cl.
CPC ..... *B31B 50/804* (2017.08); *B31B 50/102* (2017.08); *B31B 2100/0022* (2017.08); *B31B 2110/35* (2017.08); *B31B 2120/302* (2017.08)

(58) Field of Classification Search
CPC ..... B31B 50/102; B31B 50/804; B31B 2120/302; B31B 2100/0022; B31B 2110/35
See application file for complete search history.

(56) References Cited

U.S. PATENT DOCUMENTS 4,350,466 A * 9/1982 Bahr ..... B65H 3/085 271/95
5,257,888 A * 11/1993 Kronseder ..... B65G 47/904 294/65

(Continued)

FOREIGN PATENT DOCUMENTS

DE 102013014842 A1 3/2015
WO WO2010/025471 A1 3/2010

*Primary Examiner* — Thomas M Wittenschlaeger
(74) *Attorney, Agent, or Firm* — Neil G. Cohen

(57) ABSTRACT

A device for erecting a flat collapsed carrier, the device comprising a shaft (46) having a longitudinal axis (a). A hub (27) is mounted to the shaft. At least one limb (16*a-c*) is rotationally mounted to the hub by a pivot coupling. A tool head (14*a-c*) is mounted to the limb. A drive motor is coupled to the shaft for rotating the hub about the longitudinal axis. The device comprises a first drive mechanism for rotating the at least one limb with respect to the hub such that the distance between the tool head and longitudinal axis can be adjusted.

18 Claims, 9 Drawing Sheets

(56) References Cited

U.S. PATENT DOCUMENTS

| | | | | | |
|---|---|---|---|---|---|
| 5,662,577 | A * | 9/1997 | Reuteler | B65B 43/18 | 493/315 |
| 5,700,004 | A * | 12/1997 | Bahr | B65H 3/085 | 271/171 |
| 5,928,123 | A * | 7/1999 | Davis, Jr. | B31B 50/00 | 493/316 |
| 6,503,180 | B1 * | 1/2003 | Pluschow | B65B 43/185 | 493/309 |
| 7,481,420 | B2 * | 1/2009 | Iwamoto | B65H 1/22 | 271/149 |
| 7,803,099 | B2 * | 9/2010 | Biraud | B65B 43/265 | 493/313 |
| 8,047,530 | B2 * | 11/2011 | Harston | B65B 43/185 | 271/91 |
| 9,126,382 | B2 * | 9/2015 | Krueger | B65H 3/085 | |
| 10,479,619 | B2 * | 11/2019 | Mochizuki | B65G 47/918 | |
| 11,008,191 | B2 * | 5/2021 | Yoshikane | B65B 43/16 | |
| 2006/0043747 | A1 * | 3/2006 | Kniss | B25J 15/0061 | 294/65 |
| 2008/0300123 | A1 * | 12/2008 | Bonnain | B65B 43/265 | 493/310 |

* cited by examiner

ARTICLE HANDLING DEVICE FOR ERECTING CARTONS

CROSS-REFERENCE TO RELATED APPLICATIONS

This application is a National Phase application of PCT Application PCT/US18/53345, filed Sep. 28, 2018, which claims the benefit of U.S. Provisional Patent Application No. 62/574,451, filed Oct. 19, 2017, which is incorporated herein by reference in its entirety.

TECHNICAL FIELD

The present invention provides a device for handling articles. In particular, but not exclusively, the device may be used to erect flat collapsible carton blanks so as to form a tubular structure. Aspects of the invention relate to a packing machine comprising a carton erection station employing an article handling device.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton or carrier are secure within the carton.

It is known to provide such cartons as flat collapsed structures which may be pre-glued and pre-folded. Such flat collapsed structures may then be assembled, in a packaging machine, into an erected carton or carrier having an interior chamber for receiving one or more articles. It is desirable to be able to erect carton blanks of different designs and construction and with different relative arrangements of panels using a single device.

The present invention seeks to overcomes or at least mitigate the problems of the prior art, by providing a single device adaptable for erecting a plurality of different configurations of carton, and more specifically those of use in end loading packaging machines.

Furthermore, it is desired to provide a carton erection device that is compact, in order to reduce the size of a packaging machine into which the device is incorporated.

SUMMARY

A first aspect of the disclosure provides a device for erecting a flat collapsed carrier, the device comprising a shaft having a longitudinal axis. A hub is mounted to the shaft. At least one limb is rotationally mounted to the hub by a pivot coupling. A tool head may be mounted to the limb. A drive motor is coupled to the shaft for rotating the hub about the longitudinal axis. The device comprises a first drive mechanism for rotating the at least one limb with respect to the hub such that the distance between the tool head and longitudinal axis can be adjusted.

Optionally, the tool head is rotatably mounted to the at least one limb and wherein in use the tool head is rotationally driven so as to maintain a constant orientation as the hub is rotated about the longitudinal axis.

Optionally, the drive motor is coupled to the tool head by a second drive mechanism.

Optionally, the second drive mechanism comprises:

- a primary sprocket mounted to the pivot coupling;
- a concentric sprocket mounted to the pivot coupling and synchronous with primary sprocket;
- a secondary sprocket rotationally mounted to the at least one limb, the tool head being mounted to the secondary sprocket;
- a primary drive belt mounted to primary sprocket and coupled to a rotary drive machine;
- a secondary drive belt coupling the concentric sprocket to the secondary sprocket.

Optionally, the drive motor forms the rotary drive machine.

Optionally, a further drive motor forms the rotary drive machine.

Optionally, the first drive mechanism comprises:

- a first cogwheel mounted to the shaft and rotatable with respect to the hub;
- a second cogwheel fixedly mounted to the at least one limb about the pivot coupling;
- an actuator coupled to the first cogwheel to control rotation of the first cogwheel with respect to the hub.

A second aspect of the disclosure provides a carton erection device for erecting a tubular carrier structure from a flat collapsed carrier. The device comprises a shaft having a longitudinal axis. A hub is mounted to the shaft. The device comprises a plurality of limbs, each rotationally mounted to the hub by a pivot coupling. A tool head may be mounted to each of the plurality of limbs. A drive motor is coupled to the shaft for rotating the hub about the longitudinal axis. The device comprises a first drive mechanism for rotating each of the plurality of limbs with respect to the hub such that the distance between the tool heads and longitudinal axis can be adjusted.

Optionally, the drive mechanism simultaneously rotates each of the plurality of limbs with respect to the hub.

Optionally, each tool head is rotatably mounted to a respective one of the plurality of limbs and wherein in use the tool heads are rotationally driven so as to maintain a constant orientation as the hub is rotated about the longitudinal axis.

Optionally, the drive motor is coupled to each of the tool heads by a second drive mechanism.

Optionally, the second drive mechanism comprises:

- a primary sprocket mounted to each of the pivot couplings;
- a concentric sprocket mounted to each of the pivot couplings and synchronous with the respective primary sprocket;
- a secondary sprocket rotationally mounted to each of the plurality of limbs, each tool head being mounted to a respective secondary sprocket;
- a primary drive belt mounted to primary sprocket and coupled to a rotary drive machine;
- a secondary drive belt coupling the concentric sprocket to the secondary sprocket.

Optionally, the drive motor forms the rotary drive machine.

Optionally, a further drive motor forms the rotary drive machine.

Optionally, the first drive mechanism comprises:

- a first cogwheel mounted to the shaft and rotatable with respect to the hub;
- a second cogwheel fixedly mounted to each of the plurality of limbs about the respective pivot coupling;

an actuator coupled to the first cogwheel to control rotation of the first cogwheel with respect to the hub.

A third aspect of the disclosure provides an article handling apparatus for transferring an article. The apparatus comprises a shaft having a longitudinal axis. A hub is mounted to the shaft. The apparatus comprises a plurality of limbs each rotationally mounted to the hub by a pivot coupling. A tool head may be mounted to each of the plurality of limbs. A drive motor is coupled to the shaft for rotating the hub about the longitudinal axis. The apparatus comprises a first drive mechanism for rotating each of the plurality of limbs with respect to the hub such that the distance between the tool heads and longitudinal axis can be adjusted.

A fourth aspect of the disclosure provides an article handling apparatus for engaging an article comprising:

a shaft having a longitudinal axis;

a hub mounted to the shaft;

a plurality of limbs each rotationally mounted to the hub by a pivot coupling;

a tool head mounted to each of the plurality of limbs;

a drive motor coupled to the shaft for rotating the hub about the longitudinal axis;

a first drive mechanism for rotating each of the plurality of limbs with respect to the hub such that the reach of the tool heads can be adjusted.

A fifth aspect of the disclosure provides a packaging machine for packaging articles. The packaging machine comprises a conveyor for conveying an input stream of flat collapsed carriers and an erection station comprising a carton erection device arranged to sequentially engage flat collapsed carriers whilst being conveyed by the conveyor. The carton erection device erects flat collapsed carriers into tubular carrier structures. The carton erection device comprises a shaft having a longitudinal axis. A hub is mounted to the shaft. The carton erection device comprises a plurality of limbs, each rotationally mounted to the hub by a pivot coupling. A tool head may be mounted to each of the plurality of limbs. A drive motor is coupled to the shaft for rotating the hub about the longitudinal axis. The carton erection device comprises a first drive mechanism for rotating each of the plurality of limbs with respect to the hub such that the distance between the tool heads and longitudinal axis can be adjusted.

Optionally, the carton erection device erects flat collapsed carrier in which a first panel of the carrier is not in registry with a second opposing panel of the carrier when in the flat collapsed condition, the carton erection device engages the first panel and brings it into registry with the second panel to form an erected carrier structure.

Optionally, the tool heads are rotatably mounted to the limbs and wherein in use the tool heads are rotationally driven so as to maintain a constant orientation with respect to the conveyor as the hub is rotated about the longitudinal axis.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF FIGURES

Embodiments of the invention will now be described with reference to the accompanying drawings, in which.

DETAILED DESCRIPTION OF EMBODIMENTS

Detailed descriptions of specific embodiments of a device, a packaging machine and a method are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the device, packaging machine and method described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
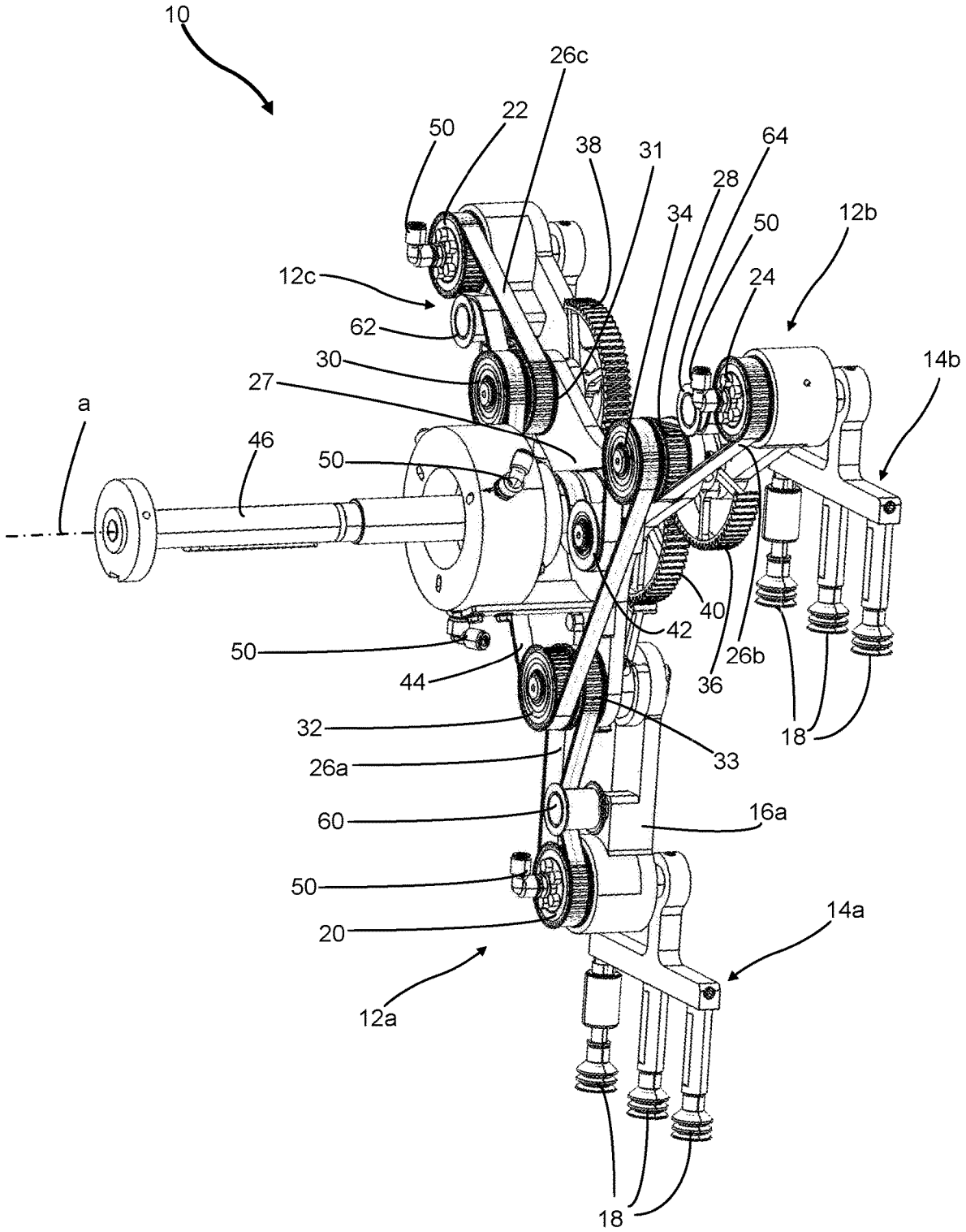
FIG. 1 illustrates a perspective view of a carton erection device according to an embodiment of the disclosure.
Figure 2:
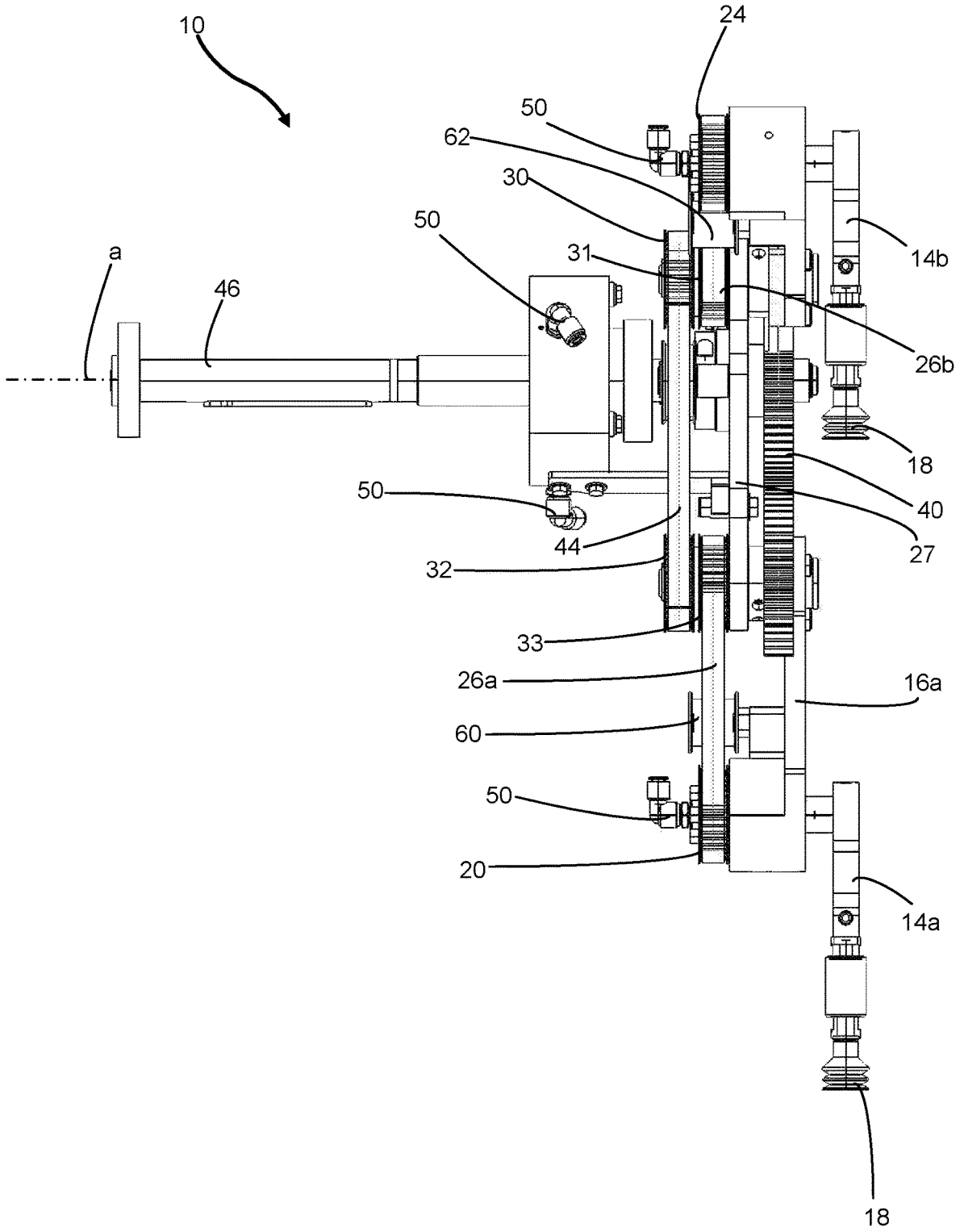
FIG. 2 illustrates an end view of the carton erection device of FIG. 1.
Figure 3:
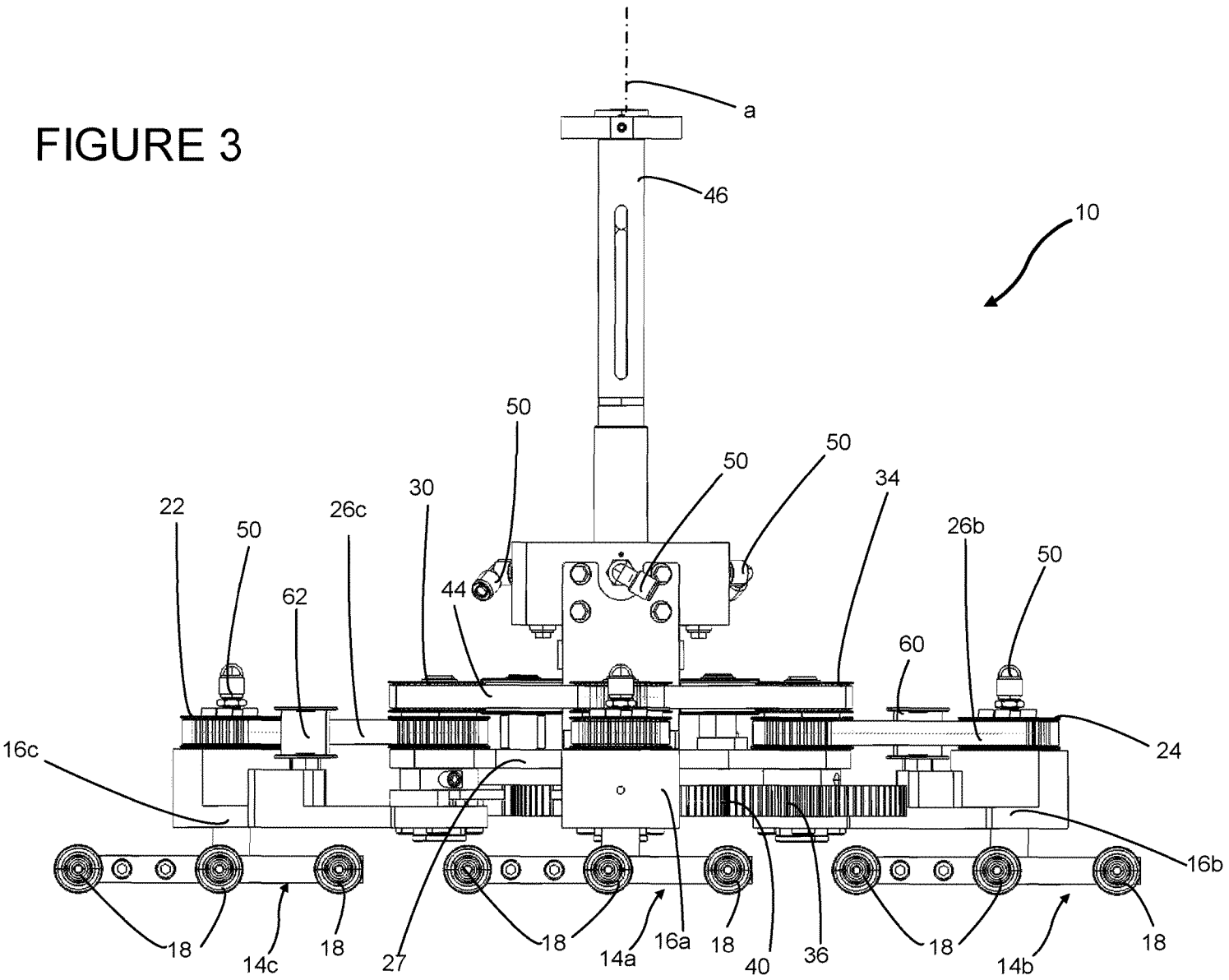
FIG. 3 illustrates a bottom view of the carton erection device of FIG. 1.
Figure 4:
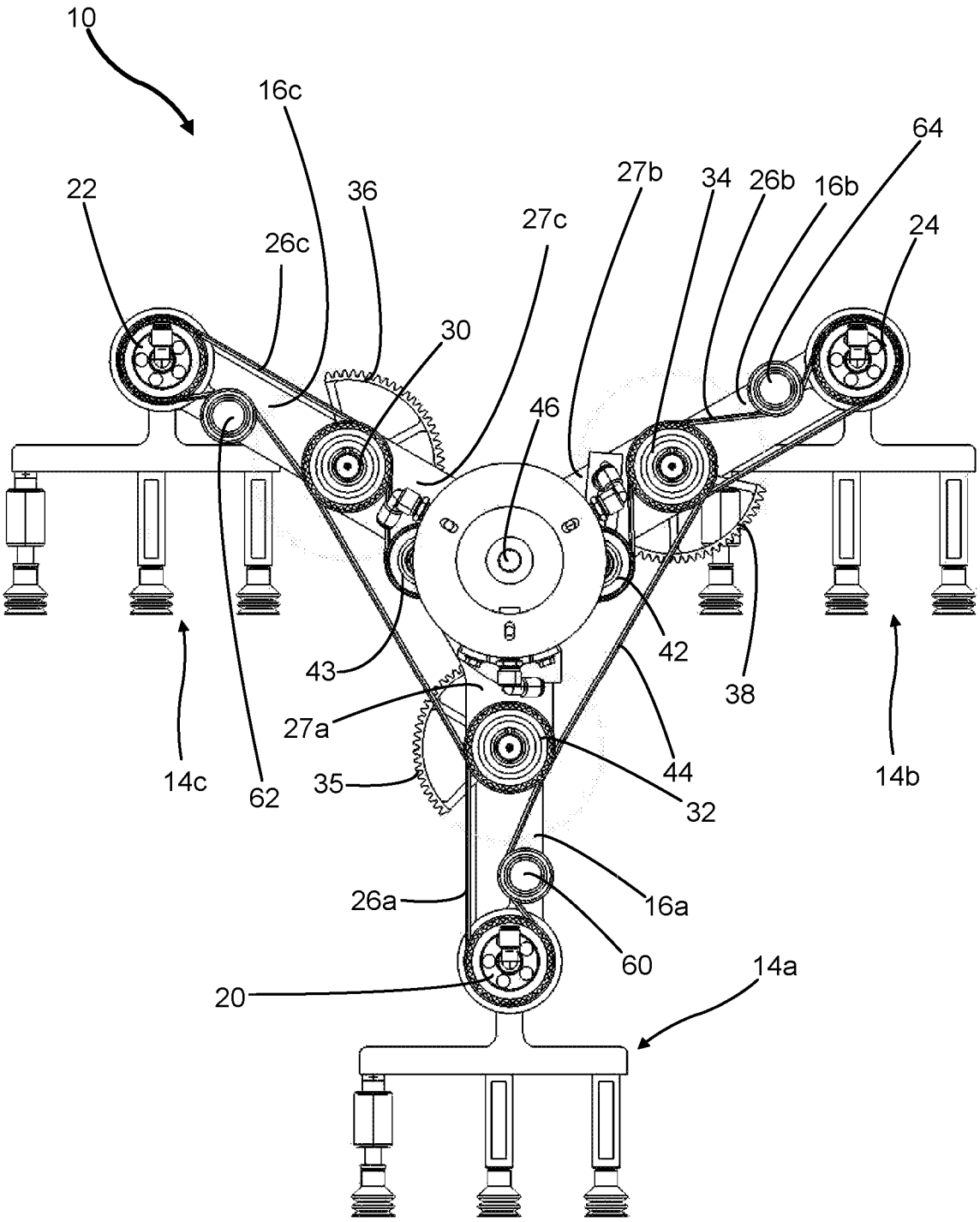
FIG. 4 illustrates first side view of the carton erection device of FIG. 1.

FIG. 1 illustrates an article handling apparatus taking the form of a carton erection device 10 capable of erecting cartons into a tubular structure from a flat collapsed configuration.

Alternatively, it is envisaged that the article handling apparatus could be employed as an article manipulation device, picking and placing an article from one location to another, for example, but not limited to, from one elevation to another.

The carton erection device 10 comprises a shaft 46; shaft 46 comprises a longitudinal axis 'a' about which the shaft 46 rotates. The shaft 46 is coupled to a drive means, not shown, such as a servo motor, to provide rotational movement of the shaft 46.

In some embodiments, the carton erection device 10 is mounted over a conveyor (not shown) the shaft 46 may be rotationally mounted to a frame (not shown) or other suitable chassis forming part of a packaging machine. One or more bearings may be provided for coupling the shaft 46 to the frame.

The shaft 46 may be oriented substantially horizontally and an arranged such that the longitudinal axis 'a' is transverse or perpendicular with respect to the direction of travel of cartons upon the conveyor.

The carton erection device 10 comprises a hub 27 mounted to the shaft 46. The illustrated embodiment comprises a trilobate hub 27, that is to say the hub comprises three arms 27*a*, 27*b*, 27*c* arranged in a "Y" shape wherein the arms are spaced 120° apart from each other.

The carton erection device 10 comprises a plurality of forearms 16*a*, 16*b*, 16*c*; a forearm 16*a*, 16*b*, 16*c* is coupled to each one of the arms 27*a*, 27*b*, 27*c* of the hub 27 respectively.

In other embodiments, the hub 27 may take an alternative shape, it may comprise more or less arms 27*a*, 27*b*, 27*c*, the arms 27*a*, 27*b*, 27*c* may be omitted, the hub 27 may be polygonal in shape for example, but not limited to, a circular in shape; the forearms 16*a*, 16*b*, 16*c* may be mounted to the hub 27 about the periphery thereof, the forearms 16*a*, 16*b*, 16*c* may be spaced apart so as to be equidistant from each other.

Figure 5:
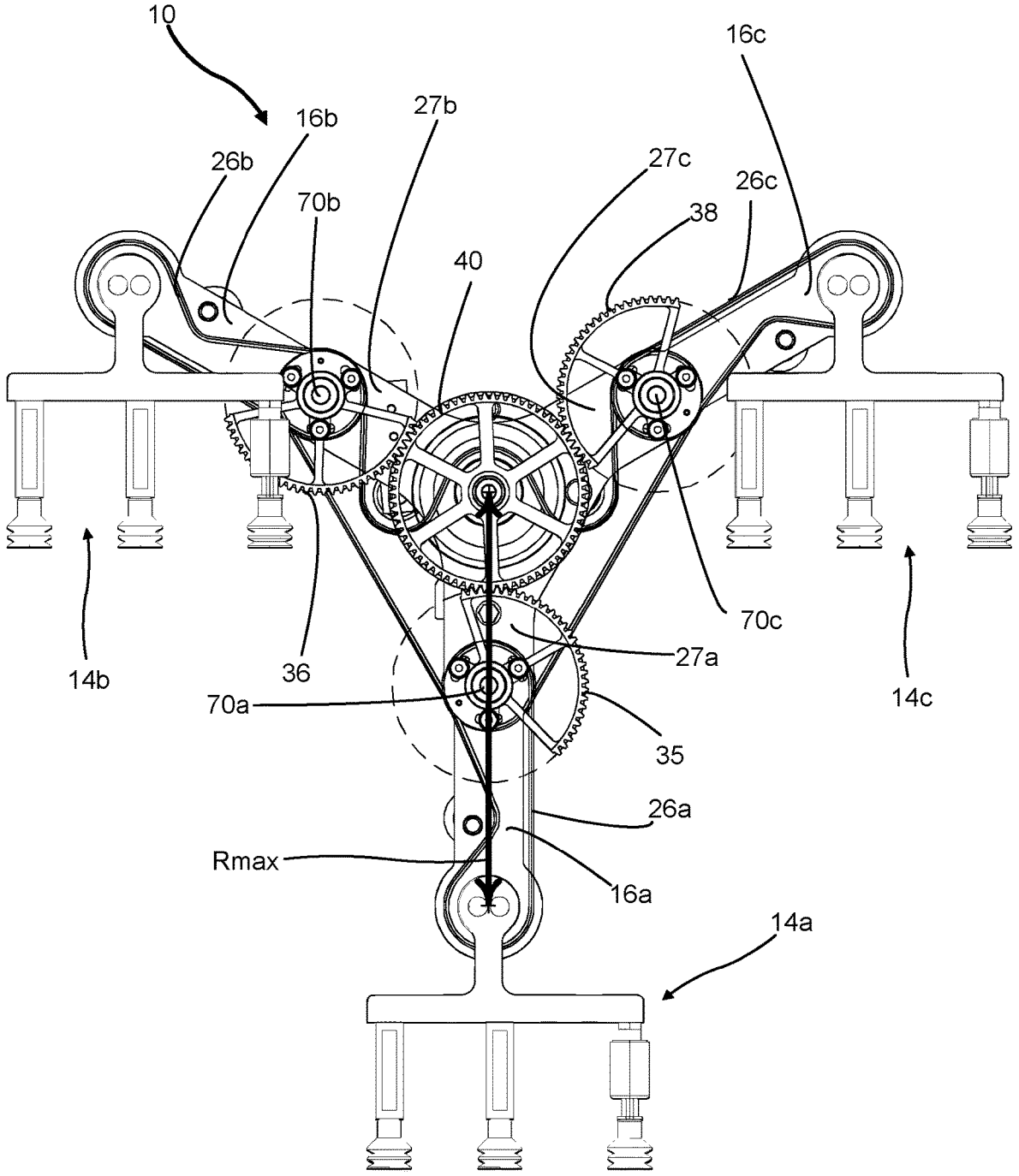
FIG. 5 illustrates second side view of the carton erection device of FIG. 1, wherein the erection device is in a first, expanded, condition.

Each of the forearms 16*a*, 16*b*, 16*c* is coupled to its respective arm 27*a*, 27*b*, 27*c* such that it can pivot about a respective coupling 70*a*, 70*b*, 70*c* (see FIG. 5).

Figure 6:
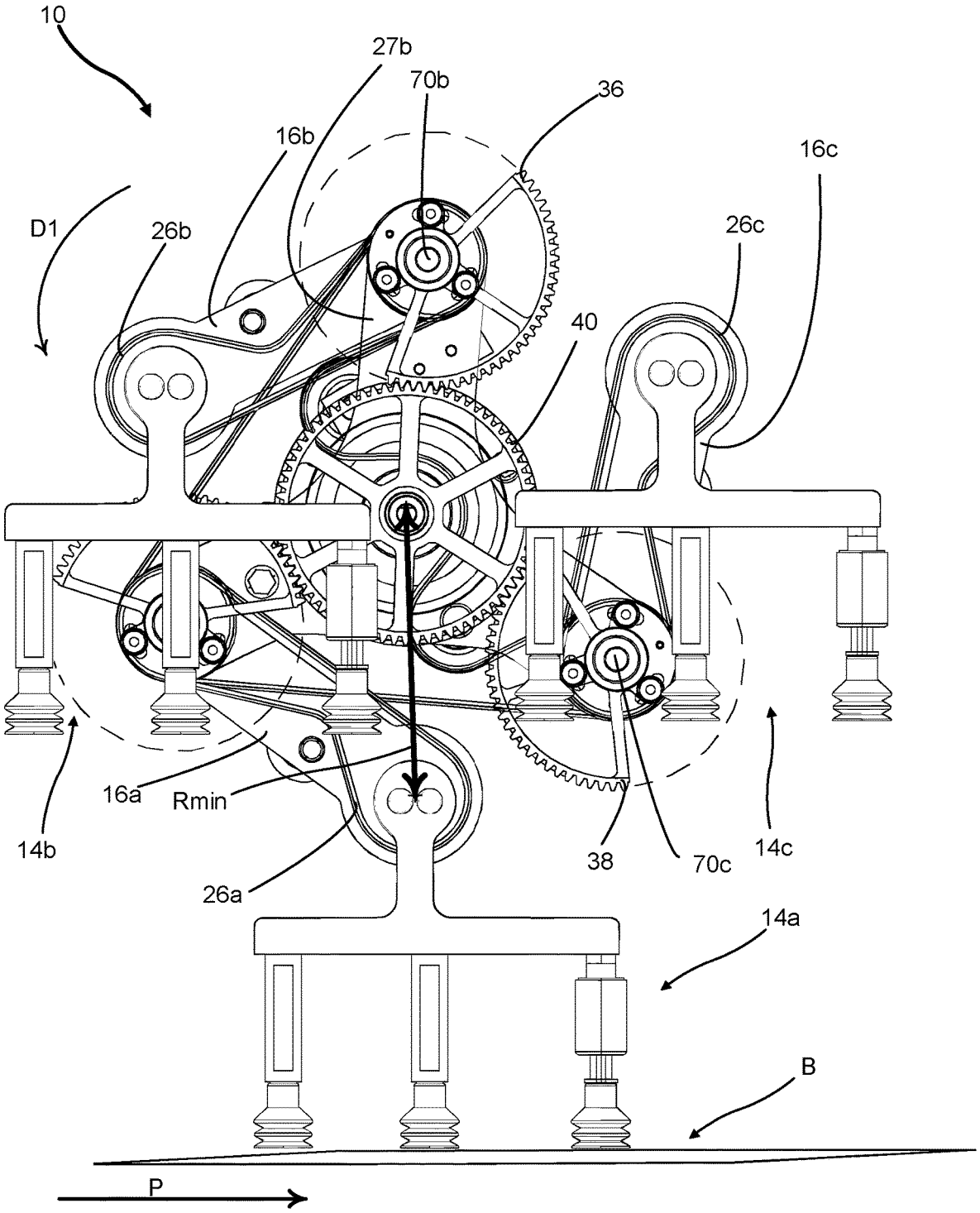
FIGS. 6 to 9 illustrate second side views of the carton erection device of FIG. 1, wherein the erection device is in a second retracted condition at various stage of erecting a carton.

The forearms 16*a*, 16*b*, 16*c* are moveable between a retracted position, shown in FIG. 6, and an extended position, shown in FIG. 5.

The carton erection device 10 comprises a tool head 14*a*, 14*b*, 14*c* coupled to each of the forearms 16*a*, 16*b*, 16*c*. The tool heads 14*a*, 14*b*, 14*c* each comprise at least one gripper device 18 in the form of a vacuum suction cup. The illustrated embodiment comprises three suction cups per tool head 14*a*, 14*b*, 14*c*. The carton erection device 10 comprises a vacuum system, elements 50 of which are shown in the Figures; tubing or hoses have been omitted for illustrative purposes.

The tool heads 14*a*, 14*b*, 14*c* are rotationally coupled to the forearms 16*a*, 16*b*, 16*c* respectively.

A first drive system is provided for controlling the orientation of each of the forearms 16*a*, 16*b*, 16*c* with respect to the hub 27. In FIG. 5 the forearms 16*a*, 16*b*, 16*c* are substantially aligned with the arms 27*a*, 27*b*, 27*c* of the hub 27. In FIG. 5 the forearms 16*a*, 16*b*, 16*c* are substantially collinear with the arms 27*a*, 27*b*, 27*c* of the hub 27. In FIG. 5 the forearms 16*a*, 16*b*, 16*c* are arranged to extend radially from the hub 27. In FIG. 6 the forearms 16*a*, 16*b*, 16*c* are arranged such that together with their respective arm 27*a*, 27*b*, 27*c* they define an acute angle so as to be in a 'folded' or retracted position.

The first drive system comprises a first gear or cogwheel 40 mounted to the shaft 46 so as to rotatable with respect to the hub 27. An actuator or drive mechanism (not shown) is coupled to the first gear 40. The drive mechanism is provided to rotate the first gear 40 with respect to the hub 27, for example, but not limited to, the drive mechanism may take the form of a motor such as a servo-motor or stepper motor. In some embodiments, the drive mechanism may comprise a manual actuator or adjustor coupled to the first gear 40, the manual actuator may take the form of a hand wheel or crank handle, an operator may extend or retract the forearms 16*a*, 16*b*, 16*c* by rotating the manual actuator. Each of the forearms 16*a*, 16*b*, 16*c* comprises a second gear or cogwheel 35, 36, 38 mounted thereto about the coupling 70*a*, 70*b*, 70*c* between the hub 27 and the respective one of the forearms 16*a*, 16*b*, 16*c*. The second gear or cogwheels 35, 36, 38 are fixed to the respective one of the forearms 16*a*, 16*b*, 16*c*. In this way rotation of the first gear 40 relative to or with respect to the hub 27 has the effect of rotating each of the forearms 16*a*, 16*b*, 16*c* about the coupling 70*a*, 70*b*, 70*c*. The forearms 16*a*, 16*b*, 16*c* are rotated together or simultaneously with respect to the hub 27 in response to rotation of the first gear 40. In this way the forearms 16*a*, 16*b*, 16*c* are moveable between the retracted position and the extended position.

In alternative embodiments, the forearms 16*a*, 16*b*, 16*c* may be moved between the extended position and retracted position by a linear actuator such as but not limited to a piston and cylinder arrangement pivotally coupled at a first end to one of the forearms 16*a*, 16*b*, 16*c* and pivotally coupled to 16*a*, 16*b*, 16*c* the hub 27 at a second opposing end.

Optionally, the second gears 35, 36, 38 are partial gears which are adapted for reciprocal rotation of the forearms 16*a*, 16*b*, 16*c* with respect to the hub 27. The second gears 35, 36, 38 may be arranged to rotate each of the forearms 16*a*, 16*b*, 16*c* through an angle between 0° and 180°. In the illustrated embodiment the second gears 35, 36, 38 are arranged to rotate each of the forearms 16*a*, 16*b*, 16*c* through an angle of rotation up to a maximum angle in the range 150° to 160°. In practice the forearms 16*a*, 16*b*, 16*c* may be rotated through an angle of rotation up to a maximum angle in the range 110° to 120°, this avoids or reduces the likelihood of the second gear disengaging from the first gear 40. In other embodiments, this may be avoided by providing a complete gear wheel similar to that of the first gear 40.

Restricting the maximum angle of rotation may also mitigate against self-collision between the tool heads 14*a*, 14*b*, 14*c*, that is to say one of the tool heads 14*a*, 14*b*, 14*c* colliding with another one of the tool heads 14*a*, 14*b*, 14*c*; it may also mitigate against self-collision between the forearms 16*a*, 16*b*, 16*c*. In other embodiments, this may be avoided by increasing the radial dimension of the hub with respect to the length of the forearms 16*a*, 16*b*, 16*c* such that the forearms 16*a*, 16*b*, 16*c* (and consequently tool heads 14*a*, 14*b*, 14*c*) can be rotated through a maximum angle of at least 180°.

The effective diameter or radius of the carton erection device 10 can be adjusted by rotating the tool heads 14*a*, 14*b*, 14*c* with respect to the hub 27. In this way the radial distance between the centre of the shaft 46, or axis 'a', and the pivot point about which the tool heads 14*a*, 14*b*, 14*c* are rotationally coupled to the forearms 16*a*, 16*b*, 16*c* can be adjusted between a maximum distance Rmax, shown in FIG. 5, where the forearms 16*a*, 16*b*, 16*c* are collinear with their respective arms 27*a*, 27*b*, 27*c* (the forearms 16*a*, 16*b*, 16*c* are radially arranged with respect to centre of the shaft 46, or axis 'a') and a minimum distance Rmin, shown in FIG. 6, where the forearms 16*a*, 16*b*, 16*c* are folded or divergently arranged with respect to their respective arms 27*a*, 27*b*, 27*c*. The reach of the carton erection device 10 can be adjusted; the forearms 16*a*, 16*b*, 16*c* can be rotated such that the maximum distance from the longitudinal axis 'a' which the tool heads 14*a*, 14*b*, 14*c* are capable of engaging an article can be varied.

A second drive system is provided for driving rotational movement of the tool heads 14*a*, 14*b*, 14*c*. The tool heads 14*a*, 14*b*, 14*c* are rotated such that their orientation with respect to the conveyor upon which the cartons are transferred is constant. The tool heads 14*a*, 14*b*, 14*c* are rotated such that grippers 18 are maintained facing the conveyor, see FIGS. 6 to 9.

The tool heads 14*a*, 14*b*, 14*c* are rotated such that grippers 18 are maintained facing the conveyor as the hub 27 (and hence the arms 27*a*, 27*b*, 27*c* and the forearms 16*a*, 16*b*, 16*c*) is rotated about the axis 'a'.

The second drive system comprises a plurality of cogwheels or pulley wheels and belts or chains. Optionally, when belts are employed the belt is toothed and the pulley wheels take the form of a toothed wheel or sprocket.

A first or primary belt 44 is mounted about the shaft 46. In the illustrated embodiment, the primary belt 44 is mounted upon three primary sprockets 30, 32, 34. A pair of idler wheels 42, 43 maintain the primary belt 44 in tension and in engagement with a drive wheel mounted to the shaft 46.

A first primary sprocket 32 is rotationally mounted to a first arm 27*a* in vertical registry with the pivot point coupling a first forearm 16*a* to the first arm 27*a*.

A second primary sprocket 34 is rotationally mounted to a second arm 27*b* in vertical registry with the pivot point coupling a second forearm 16*b* to the second arm 27*b*.

A third primary sprocket 30 is rotationally mounted to a third arm 27*c* in vertical registry with the pivot point coupling a third forearm 16*c* to the third arm 27*c*.

Rotary motion is transferred from the drive wheel upon the shaft 46 to each of the first, second and third sprockets 30, 32, 34 by the primary belt 44. The drive wheel upon the shaft 46 may be driven independently of the hub 27 such that the drive wheel rotates at a different velocity or speed to the hub 27.

In some embodiments, the drive wheel may be static or held stationary, for example, but not limited to, the drive wheel may be mounted to a frame of a packaging machine such that when the shaft 46 is rotationally driven the shaft 46 and hub 27 rotate with respect to the drive wheel. In this way, a relative rotary motion between the hub 27 and drive wheel is transferred, via the primary belt 44, to produce relative rotary motion of the sprockets 30, 32, 34 with respect to the hub 27.

The first primary sprocket 32 is coupled to a first secondary sprocket 20 by a first secondary belt 26*a*. The second primary sprocket 34 is coupled to a second secondary sprocket 24 by a second secondary belt 26*b*. The third primary sprocket 30 is coupled to a third secondary sprocket 22 by a third secondary belt 26*c*. The first secondary sprocket 20 is rotationally mounted to the first forearm 16*a*, and is coupled to the first tool head 14*a* by a shaft or spindle which is rotationally mounted to and passes through the first forearm 16*a*. The second secondary sprocket 24 is rotationally mounted to the second forearm 16*b*, and is coupled to the second tool head 14*b* by a shaft or spindle which is rotationally mounted to and passes through the second forearm 16*b*. The third secondary sprocket 22 is rotationally mounted to the third forearm 16*c*, and is coupled to the third tool head 14*c* by a shaft or spindle which is rotationally mounted to and passes through the third forearm 16*c*.

The first primary sprocket 32 is coupled to the first secondary belt 26*a* via a first concentric sprocket 34; the first concentric sprocket 33 is fixedly attached or otherwise locked to first primary sprocket 32 that is to say the first concentric sprocket 33 rotates at the same angular speed as the first primary sprocket 32.

The second primary sprocket 34 is coupled to the second secondary belt 26*b* via a second concentric sprocket 28; the second concentric sprocket 28 is fixedly attached to or otherwise locked to second primary sprocket 34 that is to say the first concentric sprocket 28 rotates at the same angular speed as the second primary sprocket 34.

The third primary sprocket 30 is coupled to the third secondary belt 26*c* via a third concentric sprocket 31; the third concentric sprocket 31 is fixedly attached or otherwise locked to third primary sprocket 30 that is to say the third concentric sprocket 31 rotates at the same angular speed as the third primary sprocket 30.

In the illustrated embodiment, the first, second and third concentric sprockets 33, 28, 31 have substantially the same diameter as the respective one of the primary sprocket 32, 32, 34; although it will be appreciated that the diameter may be altered to any desired ratio such that the output speed, the angular speed of the tool heads 14*a*, 14*b*, 14*c*, may be greater than or less than the input speed, the angular speed of the drive wheel with respect to the hub 27.

In some embodiments, the first, second and third concentric sprockets 33, 28, 31 maybe unitary with respective one of first, second and third primary sprockets 32, 34, 30.

In still other embodiments, the spindles or shafts upon which the first, second and third primary sprockets 32, 34, 30 may be keyed or may comprise a spline, along a mounting portion thereof. The first, second and third primary sprockets 32, 34, 30 and the first, second and third concentric sprockets 33, 28, 31 are mounted upon the mounting portion such that each of the first, second and third concentric sprockets 33, 28, 31 is locked in rotation with the respective one of the first, second and third primary sprockets 32, 34, 30.

The second drive system comprises an idler pulley 60, 62, 64 mounted to each of the first, second and third forearms 16*a*, 16*b*, 16*c*. The idler pulleys may be employed to maintain a desired tension in the secondary belts 26*a*, 26*b*, 26*c*. Additionally or alternatively, the idler pulleys may be employed to route the secondary belts 26*a*, 26*b*, 26*c* around a larger proportion of the circumference first, second and third secondary sprockets 20, 22, 24 and/or the first, second and third concentric sprockets 33, 28, 31.

The carton erection device 10 can be employed to open or erect cartons or carriers from a flat-collapsed condition to an erected condition. FIGS. 6 to 9 illustrate various stages of operation of the carton erection device 10. A carton B is shown being conveyed upon a conveyor (not shown) in downstream direction P, the carton B is initially in flat collapsed state as schematically illustrated in FIG. 6. The tool head 14*a* is brought into engagement with the carton B as it is moved in the downstream direction. The grippers 18 are brought into engagement with a first panel W of the carton B. The carton B is continuously moved downstream through an erection station of a packaging machine during the erection process. The tool head 14*a* is brought into engagement with the carton B by rotation of the hub 27 about the shaft 46 in a direction indicated by direction D1. In the illustrated embodiment, the tool head 14*a* is rotated so as to move at least in part in the downstream direction P when in engagement with the carton B. In other embodiments, the tool head 14*a* may be rotated about shaft 46 in the opposing direction so as to move at least in part in an upstream direction (opposing the downstream direction P) when in engagement with the carton B.

Figure 7:
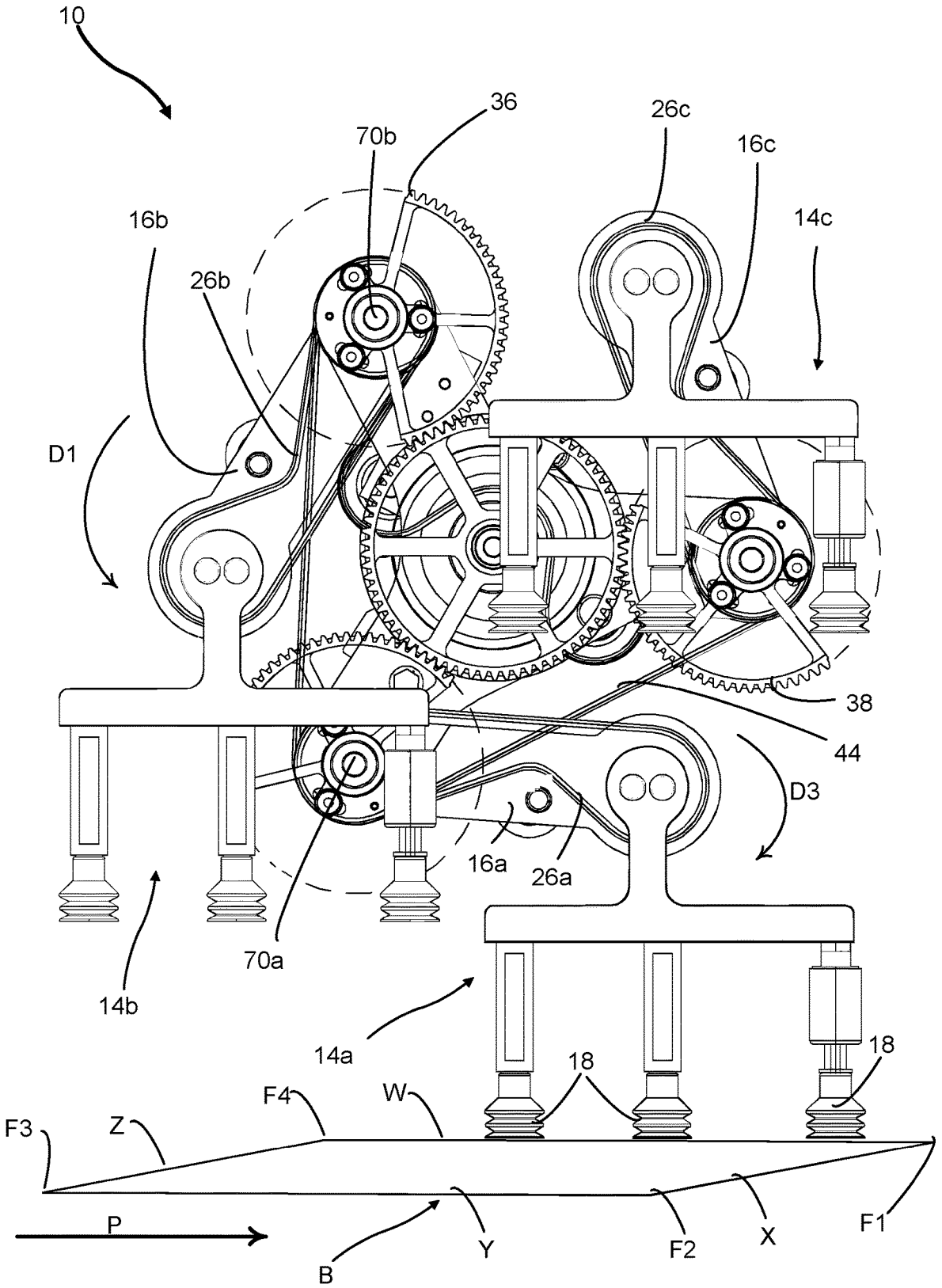

FIG. 7 illustrates the carton B in a partially erected state, the hub 27 has been rotated about the longitudinal axis 'a' as indicted by direction arrow D1 such that the first tool head 14*a* is moved downstream (direction arrow P) and upwardly or away from the conveyor upon which the carton B is being conveyed. In doing so the first panel W is separated from an opposing second panel Y, third panel X and fourth panel Z which couple opposing ends of the first panel W to respective opposing ends of the second panel Y are folded with respect to the first and second panels W, Y about fold lines F1, F2, F3, F4. The first tool head 14*a* is rotated with respect the first forearm 16*a* as indicated by direction arrow D3, in this way grippers 18 maintain the first panel W substantially parallel to the second panel Y. The direction of rotation of the first tool head 14*a* with respect the first forearm 16*a* is opposite the direction of rotation of the hub 27 about the about the longitudinal axis 'a'.

The carton erection device 10 has the effect of moving the first panel W in an upstream direction as indicated by direction arrow D2 with respect to the second panel Y, whilst simultaneously separating or spacing apart the first and second panels W, Y. It will be appreciated that relative movement between the first and second panels W, Y is required, this may be achieved for example, but not limited to, retarding the speed or velocity of movement of the first panel W in the downstream direction P.

Figure 8:
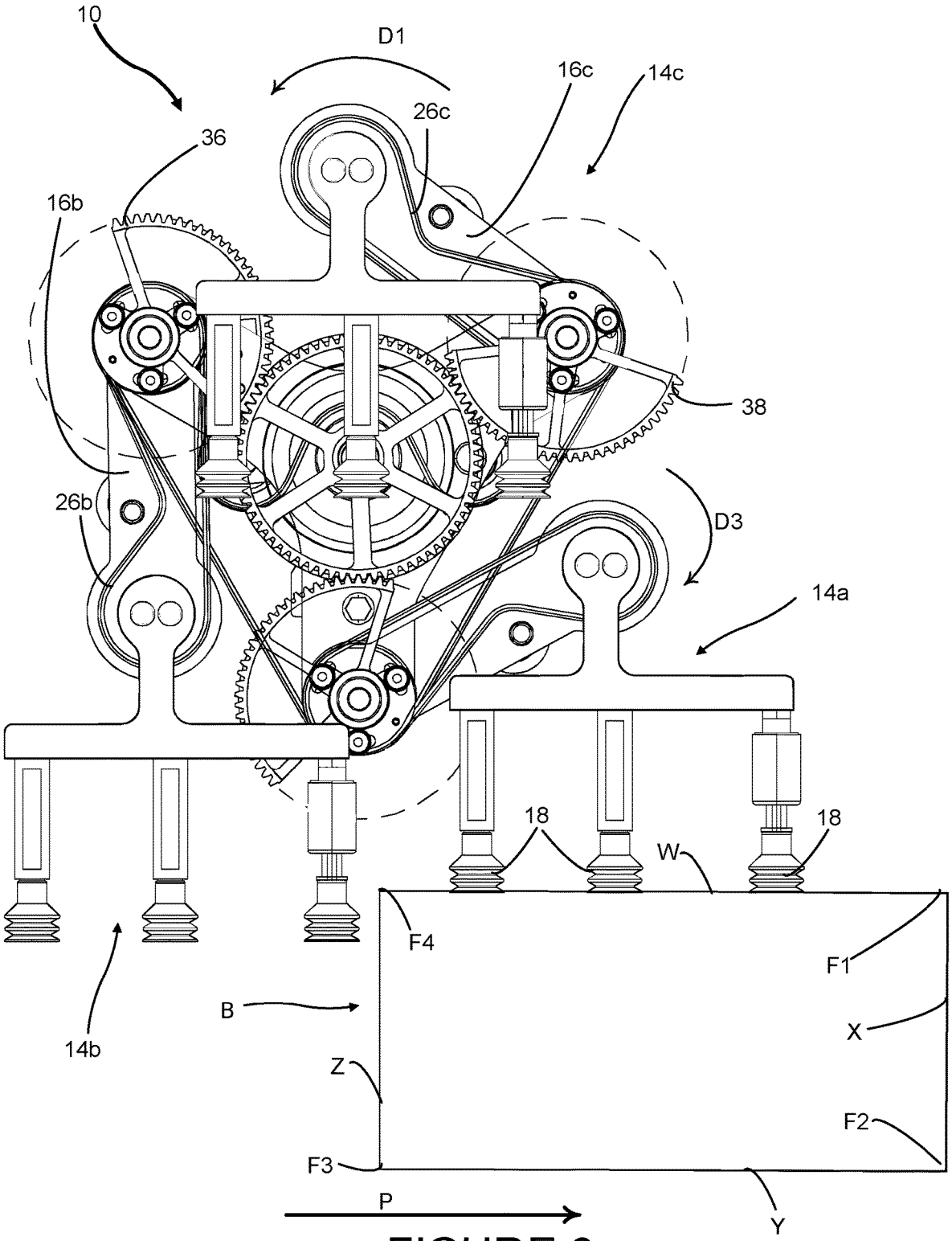
Figure 9:
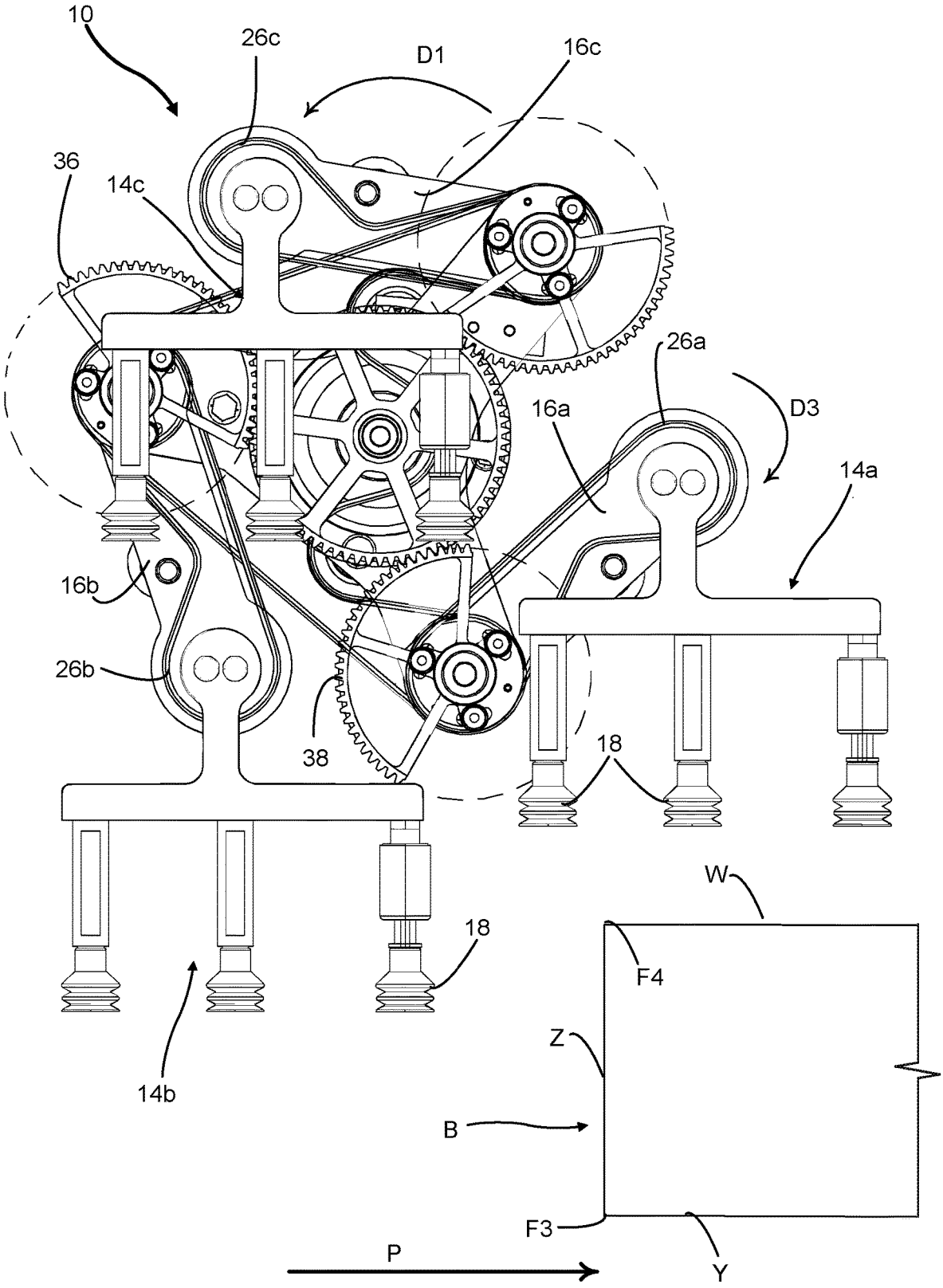

FIGS. 8 and 9 illustrate the carton B in an erected condition, in FIG. 9 the first tool head 14*a* has disengaged from the carton B which is now conveyed downstream for further processing by the packaging machine. The second tool head 14*b* has been rotated towards the conveyor in preparation for engagement with a subsequent carton (not shown) upon the conveyor.

The carton erection device 10 is adaptable such that it may be employed with a variety of carton having different size, shape or configuration.

The carton erection device 10 may be mounted to the packaging machine such that the shaft 46 is located at a distance (height) from the conveyor which is dependent upon the requirements of the desired carton configuration being processed by the packaging machine. In this way packaging machines may be readily constructed which employ a common carton erection device 10 but which process different carton types or configuration. The position or orientation of forearms 16*a*, 16*b*, 16*c* with respect to the hub 27 may be adjusted accordingly.

The carton erection device 10 may be mounted to a packaging machine such that the distance (height) of the shaft 46 from the conveyor may be altered, varied and/or adjusted. This may take form of a manual adjustment requiring downtime or stoppage of the packaging machine or may be automated such that any downtime or stoppage of the packaging machine may be reduced or eliminated. In this way, a single packaging machine may be readily adapted to process different carton types or configurations. It will be appreciated that the mounting location of the carton erection device 10 to a frame or chassis may be fixed and the height or elevation of the conveyor may be adjusted with respect to the carton erection device 10.

The present disclosure provides a carton erection device having at least one tool head for engaging with cartons or carriers provided in a continuous stream upon a conveyor. The carton erection device is adjustable such that the reach of the tool head can be varied according to the requirements of the desired carton being erected.

The tool heads of the carton erection device engage with the carton at a first upstream location and disengage at second downstream location. The limbs of the carton erection device can be adjusted such that a first upstream location can be adjusted. The limbs of the carton erection device can be adjusted such that a first upstream location can be adjusted. In this way, the period of time which the tool head is in engagement with the carton can be adjusted, in this way the working reach, the linear distance between first upstream location and the second downstream location, can be altered.

It can be appreciated that various changes may be made within the scope of the present invention. For example, the size and shape of the panels and apertures may be adjusted to accommodate articles of differing size or shape.

References to directional features such as "top", "bottom", "vertical", "horizontal", "topmost", "uppermost", "lowermost", "base", "front", "back", "end", "side", "inner", "outer", "upper" and "lower" serve only to differentiate their respective components or features from one another, and should not be seen as limiting those respective components or features to a particular orientation; it will be understood that other embodiments may be used in which such directional features are altered without departing from the scope of the present disclosure.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A device for erecting a carrier, the device comprising:

a shaft having a longitudinal axis;

a hub mounted to the shaft;

at least one limb rotationally mounted to the hub by a pivot coupling;

a tool head mounted to the limb;

a drive motor coupled to the shaft for rotating the hub about the longitudinal axis;

a first drive mechanism for rotating the at least one limb with respect to the hub such that a distance between the tool head and the longitudinal axis can be adjusted, wherein the first drive mechanism comprises:

a first cogwheel mounted to the shaft and rotatable with respect to the hub;

a second cogwheel fixedly mounted to the at least one limb about the pivot coupling; and an actuator coupled to the first cogwheel to control rotation of the first cogwheel with respect to the hub.

2. A device according to claim 1 wherein the tool head is rotatably mounted to the at least one limb and wherein in use the tool head is rotationally driven so as to maintain a constant orientation as the hub is rotated about the longitudinal axis.

3. A device according to claim 1 comprising a second drive mechanism coupled to the tool head for driving rotational movement of the tool head.

4. A device according to claim 3 wherein the second drive mechanism comprises:

a primary sprocket mounted to the pivot coupling;

a concentric sprocket mounted to the pivot coupling and synchronous with the primary sprocket;

a secondary sprocket rotationally mounted to the at least one limb, the tool head being mounted to the secondary sprocket;

a primary drive belt mounted to the primary sprocket and coupled to a rotary drive machine;

a secondary drive belt coupling the concentric sprocket to the secondary sprocket.

5. A device according to claim 4 wherein the drive motor forms the rotary drive machine.

6. A device according to claim 4 wherein a further drive motor forms the rotary drive machine.

7. A device according to claim 1 wherein the at least one limb comprises a plurality of limbs rotationally mounted to the hub by respective pivot couplings, with a tool head mounted to each of the plurality of limbs, and wherein the first drive mechanism simultaneously rotates each of the plurality of limbs with respect to the hub.

8. A device according to claim 7 wherein each tool head is rotatably mounted to a respective one of the plurality of limbs and wherein in use the tool heads are rotationally driven so as to maintain a constant orientation as the hub is rotated about the longitudinal axis.

9. A device according to claim 7 wherein a second drive mechanism is coupled to each of the tool heads for driving rotational movement of the tool heads.

10. A device according to claim 9 wherein the second drive mechanism comprises:

a primary sprocket mounted to each of the pivot couplings;

a concentric sprocket mounted to each of the pivot couplings and synchronous with the respective primary sprocket;

a secondary sprocket rotationally mounted to each of the plurality of limbs, wherein each tool head is mounted to the secondary sprocket, respectively;

a primary drive belt mounted to primary sprocket and coupled to a rotary drive machine;

a secondary drive belt coupling the concentric sprocket to the secondary sprocket.

11. A device according to claim 10 wherein the drive motor forms the rotary drive machine.

12. A device according to claim 10 wherein a further drive motor forms the rotary drive machine.

13. A device according to claim 1, wherein the first drive mechanism is configured to rotate the at least one limb with respect to the hub, which rotation causes a reach of the tool head mounted to each limb to be adjusted dependent upon the characteristics of the carrier being erected, and wherein a relative distance between a conveyor and a position at which the device is mounted is adjustable dependent upon the characteristics of the carrier being erected.

14. A device according to claim 1, wherein each tool head comprises at least one gripper device as part of a vacuum system, the at least one gripper device of each tool head configured to be brought into engagement with a portion of the carrier to grip the portion of the carrier in erecting the carrier.

15. A device for erecting a carrier, the device comprising:

a shaft having a longitudinal axis;

a hub mounted to the shaft;

at least one limb rotationally mounted to the hub by a pivot coupling;

a tool head mounted to the limb;

a drive motor couple to the shaft for rotating the hub about the longitudinal axis;

a first drive mechanism for rotating the at least one limb with respect to the hub such that a distance between the tool head and the longitudinal axis can be adjusted;

wherein the at least one limb comprises a plurality of limbs rotationally mounted to the hub by respective pivot couplings, with a tool head mounted to each of the plurality of limbs, and wherein the first drive mechanism simultaneously rotates each of the plurality of limbs with respect to the hub;

wherein the first drive mechanism comprises:

a first cogwheel mounted to the shaft and rotatable with respect to the hub;

an actuator coupled to the first cogwheel to control rotation of the first cogwheel with respect to the hub.

16. A packaging machine for packaging articles, the packaging machine comprising;

a conveyor for conveying an input stream of flat collapsed carriers;

an article handling apparatus comprising the device of claim 15 arranged to sequentially engage flat collapsed carriers whilst being conveyed by the conveyor.

17. A packaging machine according to claim 16 wherein the article handling apparatus is employed to erect a flat collapsed carrier in which a first panel of the carrier is not in registry with a second opposing panel of the carrier when in a flat collapsed condition, the article handling apparatus is configured to engage the first panel and bring it into registry with the second panel to form an erected carrier structure.

18. A packaging machine according to claim 16 wherein each of the tool heads is rotatably mounted to each of the plurality of limbs, respectively, and wherein in use the tool heads are rotationally driven so as to maintain a constant orientation with respect to the conveyor as the hub is rotated about the longitudinal axis.

* * * * *